US008997847B2

(12) United States Patent
Schwartz

(10) Patent No.: US 8,997,847 B2
(45) Date of Patent: Apr. 7, 2015

(54) COOLING IN A LIQUID-TO-AIR HEAT EXCHANGER

(75) Inventor: William Samuel Schwartz, Pleasant Ridge, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 958 days.

(21) Appl. No.: 12/879,630

(22) Filed: Sep. 10, 2010

(65) Prior Publication Data

US 2012/0061069 A1 Mar. 15, 2012

(51) Int. Cl.

| | |
|---|---|
| ***F24F 11/04*** | (2006.01) |
| ***F24F 11/06*** | (2006.01) |
| ***F01P 7/16*** | (2006.01) |
| ***F01P 7/04*** | (2006.01) |

(52) U.S. Cl.

CPC *F01P 7/164* (2013.01); *F01P 7/042* (2013.01)

(58) Field of Classification Search

CPC ..... B60H 1/004; B60H 1/00007; B60H 1/00885; F01P 7/10; F24F 11/0076; F24F 11/0079; F24F 11/008; F24F 11/006

USPC ..... 165/271, 244, 245, 246, 247

See application file for complete search history.

(56) References Cited

U.S. PATENT DOCUMENTS

| | | | | |
|---|---|---|---|---|
| 4,591,691 | A * | 5/1986 | Badali | 237/12.3 B |
| 4,955,431 | A * | 9/1990 | Saur et al. | 165/271 |
| 4,974,664 | A * | 12/1990 | Glennon et al. | 165/271 |
| 4,977,862 | A | 12/1990 | Aihara et al. | |
| 5,036,803 | A * | 8/1991 | Nolting et al. | 123/41.1 |
| 5,573,181 | A * | 11/1996 | Ahmed | 165/244 |
| 5,678,761 | A * | 10/1997 | Ikeda | 237/2 B |
| 6,042,016 | A * | 3/2000 | Ikeda | 237/12.3 C |
| 6,109,219 | A * | 8/2000 | Sano | 123/41.1 |
| 6,142,108 | A * | 11/2000 | Blichmann | 123/41.05 |
| 6,178,928 | B1 * | 1/2001 | Corriveau | 123/41.12 |
| 6,216,645 | B1 * | 4/2001 | Bobretzky et al. | 123/41.15 |
| 6,286,311 | B1 * | 9/2001 | Chen | 123/41.13 |
| 6,343,572 | B1 * | 2/2002 | Pfaff et al. | 123/41.01 |
| 6,394,045 | B1 * | 5/2002 | Perset | 123/41.44 |
| 6,450,275 | B1 | 9/2002 | Gabriel et al. | |
| 6,530,426 | B1 * | 3/2003 | Kishita et al. | 165/271 |
| 6,772,715 | B2 * | 8/2004 | Pfeffinger et al. | 123/41.31 |
| 6,786,183 | B2 * | 9/2004 | Hoelle et al. | 123/41.44 |

(Continued)

OTHER PUBLICATIONS

Setlur, Pradeep et al., An Advanced Engine Thermal Management System: Nonlinear Control and Test, IEEE/ASME Transactions on Mechatronics, vol. 10, No. 2, Apr. 2005, pp. 210-220.

(Continued)

*Primary Examiner* — Ljiljana Ciric

(74) *Attorney, Agent, or Firm* — Julia Voutyras; Brooks Kushman P.C.

(57) ABSTRACT

A system and method for controlling cooling an engine involve an engine coolant circuit with a radiator and an engine, a fan and a coolant pump are provided. The fan and pump may be electrically driven, driven by a variable speed clutch, hydraulically driven, or driven by some other actively controllable means. When an increase in heat transfer rate is indicated, the fan speed or the coolant pump speed may be increased. The choice of increasing the fan speed or increasing the pump speed is determined so that the power consumed is minimized. dQ/dP, the gradient in heat transfer rate to power, is determined for both the fan and the pump at the present operating condition. The one with the higher gradient is the one that is commanded to increase speed.

20 Claims, 4 Drawing Sheets

(56) References Cited

U.S. PATENT DOCUMENTS

| | | | | |
|---|---|---|---|---|
| 6,789,512 | B2 * | 9/2004 | Duvinage et al. | 123/41.05 |
| 6,945,324 | B2 * | 9/2005 | Weng | 236/49.3 |
| 7,263,954 | B2 * | 9/2007 | Piddock et al. | 123/41.09 |
| 7,267,086 | B2 * | 9/2007 | Allen et al. | 123/41.44 |
| 7,454,896 | B2 * | 11/2008 | Chalgren et al. | 60/278 |
| 7,591,302 | B1 * | 9/2009 | Lenehan et al. | 165/247 |
| 7,918,129 | B2 * | 4/2011 | Coppola et al. | 73/114.68 |
| 8,196,553 | B2 * | 6/2012 | Kline et al. | 123/41.11 |
| 8,434,432 | B2 * | 5/2013 | Magro | 123/41.1 |
| 8,700,221 | B2 * | 4/2014 | Cheng et al. | 700/282 |
| 8,708,071 | B2 * | 4/2014 | Yokoyama et al. | 165/271 |
| 8,833,313 | B2 * | 9/2014 | Lockwood et al. | 165/271 |
| 8,905,123 | B2 * | 12/2014 | Miura | 165/244 |
| 8,910,705 | B2 * | 12/2014 | Miura | 165/244 |
| 2002/0174840 | A1 * | 11/2002 | Luckner et al. | 123/41.1 |
| 2006/0040149 | A1 | 2/2006 | Aso et al. | |
| 2006/0180300 | A1 * | 8/2006 | Lenehan et al. | 165/247 |
| 2006/0213461 | A1 | 9/2006 | Hayami | |
| 2009/0229543 | A1 | 9/2009 | Suzuki | |
| 2012/0168140 | A1 * | 7/2012 | Yokkoyama et al. | 165/271 |
| 2013/0075075 | A1 * | 3/2013 | Tokuda et al. | 165/202 |

OTHER PUBLICATIONS

Staunton, N., et al., Abstract of Assessment of Advanced Thermal Management Systems for Micro-Hybrid Trucks and Heavy Duty Diesel Vehicles, Vehicle Power and Propulsion Conference, Sep. 3-5, 2008, pp. 1.

Allen, David J, et al., Abstract of Thermal Management Evolution and Controlled Coolant Flow, SAE International, May 2001, Doc. No. 2001-01-1732, pp. 1.

* cited by examiner

Figure 4
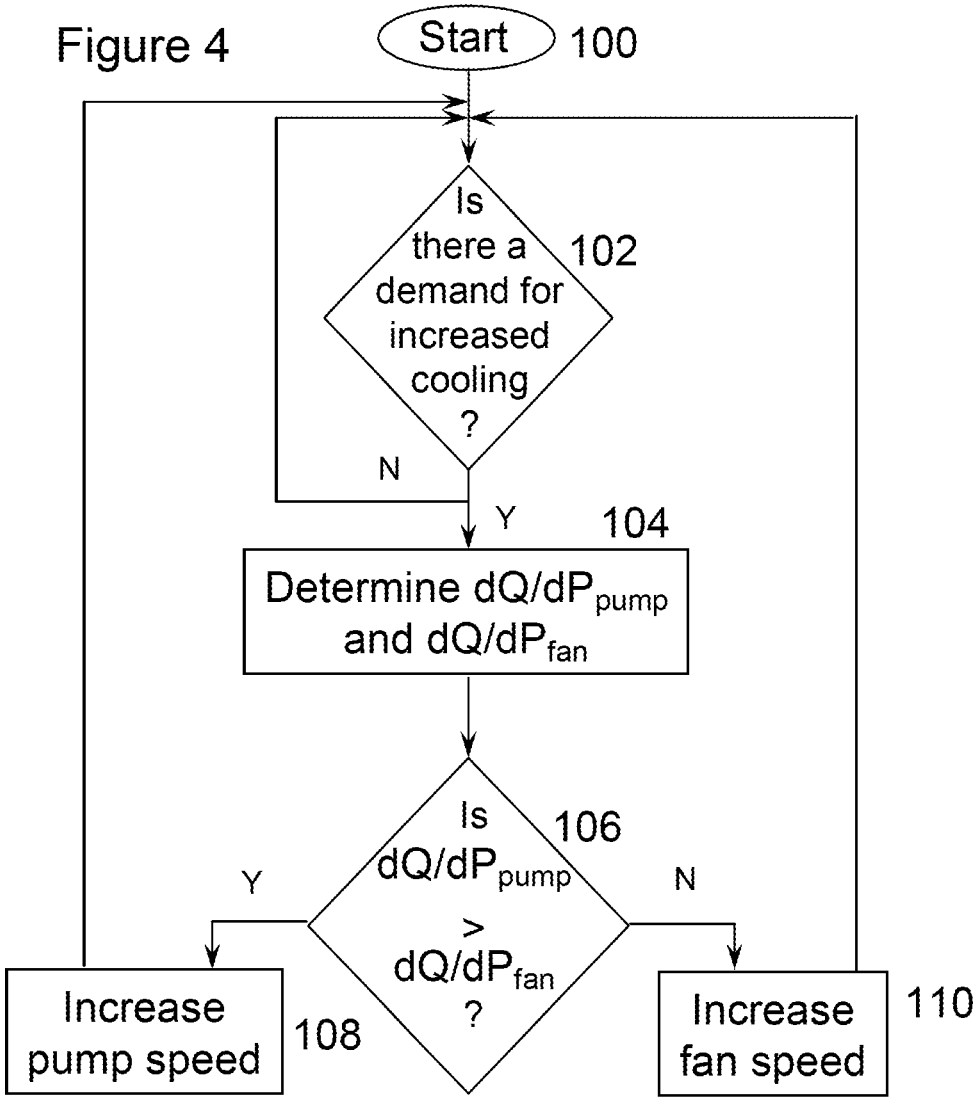
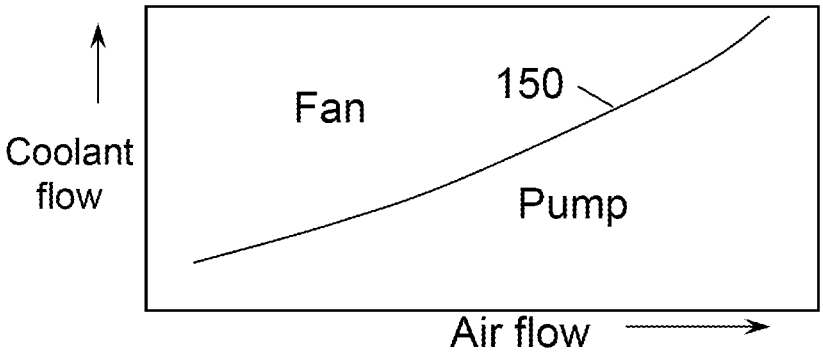
Figure 6

COOLING IN A LIQUID-TO-AIR HEAT EXCHANGER

BACKGROUND

1. Technical Field

The present disclosure relates to providing a desired cooling level in a liquid-to-air heat exchanger in an energy efficient manner.

2. Background Art

In most production vehicles, the water pump that causes engine coolant to circulate through the engine and radiator is driven by the engine and the speed of the pump is dictated by the rotational speed of the engine. To ensure that there is sufficient coolant flow at the most demanding operating condition, the amount of flow at most operating conditions is higher than necessary. To improve control over the pump speed, the pump is decoupled from the engine and is either driven by an electric motor, driven by a variable speed clutch, hydraulically driven, or driven by some other actively controllable means. The electrically driven variant is particularly suited to a vehicle with a significant capacity for electrical power generation such as a hybrid electric vehicle.

It is common for a fan to be provided to direct air flow across the fins and tubes of the radiator. The fan is commonly electrically driven, although it too may be driven by a variable speed clutch, hydraulically driven, or driven by some other actively controllable means. The flow across the radiator is due to movement of the vehicle and the fan.

When an increase in heat transfer rate is indicated, the fan speed or the coolant pump speed may be increased.

SUMMARY

According to an embodiment of the disclosure, the choice of increasing the fan speed or increasing the pump speed is determined so that the power consumed is minimized. The broad concept is that dQ/dP, the gradient in heat transfer rate to power, is determined for both the fan and the pump at the present operating condition. The one with the higher gradient is the one that is commanded to increase speed.

A method to control cooling in a liquid-to-air heat exchanger with a fan and a pump forcing convection is disclosed including: determining a first gradient in heat transfer rate to fan power associated with adjusting fan speed, determining a second gradient in heat transfer rate to pump power associated with adjusting pump speed, and adjusting one of fan speed and pump speed based on the gradients. The method may further include determining whether a change in heat transfer is indicated and the adjusting one of fan speed and pump speed is further based on such change in heat transfer being indicated. The fan speed is increased when the first gradient is greater than the second gradient and an increase in heat transfer is indicated. The pump speed is increased when the second gradient is greater than the first gradient and an increase in heat transfer is indicated. The fan speed is decreased when the second gradient is greater than the first gradient and a decrease in heat transfer is indicated. The pump speed is decreased when the first gradient is greater than the second gradient and a decrease in heat transfer is indicated. The liquid is a coolant typically comprising water and ethylene glycol. The liquid is contained within a duct and the air may or may not be ducted. The liquid-to-air heat exchanger is called a radiator and the first and second gradients are determined by: evaluating a radiator performance relationship with radiator performance as a function of liquid coolant and air flows and/or velocities and transforming the radiator performance relationship into a heat transfer performance relationship with heat transfer rate as a function of liquid coolant and air flows and/or velocities. Radiator performance information may take one of several forms including: effectiveness, heat transfer per unit temperature difference between the bulk coolant and air flow streams entering the radiator, or any other suitable manner to capture performance. The performance relationships may be expressed as lookup tables, graphs, or empirical formulas. The first gradient is determined for increased fan speed and the second gradient is determined for increased pump speed when an increase in heat transfer is indicated. The first gradient is determined for decreased fan speed and the second gradient is determined for decreased pump speed when a decrease in heat transfer is indicated.

A method to control cooling in a liquid-to-air heat exchanger with a fan and a pump forcing convection is disclosed that includes determining a first gradient in heat transfer to power for increasing fan speed, determining a second gradient in heat transfer to power for increasing pump speed, increasing fan speed when the first gradient is greater than the second gradient, and increasing pump speed when the second gradient is greater than the first gradient. The method may further include determining whether an increase in heat transfer is desired. The choice of increasing fan speed and/or pump speed is further based on such a determination that an increase in heat transfer is desired. The first gradient is determined based on determining a gradient in heat transfer rate to air flow from a map of radiator performance and determining a gradient in air flow to fan power and the second gradient is determined based on determining a gradient in heat transfer rate to coolant flow from a map of radiator performance and determining a gradient in coolant flow to pump power.

A cooling system for an automotive engine includes a radiator coupled to an engine cooling circuit in which the engine is disposed, a fan forcing air past the radiator, a pump disposed in the cooling circuit, and an electronic control unit electronically coupled to the fan and the pump. The electronic control unit commands the fan and/or the pump to change operating speed when an adjustment in heat transfer rate is indicated. In some situations, the adjustment in heat transfer may be realized by increasing either the fan speed or the pump speed. The electronic control unit determines which of the fan and the pump to command based on a first gradient of heat transfer rate to power for adjusting fan speed and a second gradient of heat transfer rate to power for adjusting pump speed. The fan and the pump may be electrically driven, driven by a variable speed clutch, hydraulically driven, or driven by some other actively controllable means. The system may have various sensors and actuators coupled to the electronic control unit including: an ambient temperature sensor electronically coupled to the electronic control unit, an engine coolant sensor electronically coupled to the engine coolant circuit, and a vehicle speed sensor electronically coupled to the electronic control unit. The first and second gradients may further be based on inputs from the sensors which include the ambient temperature, the engine coolant temperature, and the vehicle speed.

The fan speed is commanded to increase when the first gradient is greater than the second gradient and an increase in heat transfer is indicated. The pump speed is commanded to increase when the second gradient is greater than the first gradient and an increase in heat transfer is indicated. The fan speed is commanded to decrease when the second gradient is greater than the first gradient and a decrease in heat transfer is indicated. The pump speed is commanded to decrease when the first gradient is greater than the second gradient and a decrease in heat transfer is indicated. The amount of the fan speed increase or decrease and the amount of the pump speed increase or decrease is based on an amount of a change in heat transfer rate that is indicated. In some situations, both fan and pump speeds may be increased simultaneously. These situations may include situations when increasing one or the other in isolation may not provide the desired increase in heat transfer performance. Further, in these situations, the aforementioned logic may be utilized to determine the speed increase for each actuator so as to realize the least combined usage of energy between them for increasing heat transfer by changing both fan and pump speed simultaneously.

BRIEF DESCRIPTION OF THE DRAWINGS

FIGS. 4 and 5 are flowcharts according to embodiments of the present disclosure; and FIG. 6 is a graph illustrating ranges at which fan or pump usage is preferred by performing a power analysis.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated and described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations consistent with the present disclosure, e.g., ones in which components are arranged in a slightly different order than shown in the embodiments in the Figures. Those of ordinary skill in the art will recognize that the teachings of the present disclosure may be applied to other applications or implementations.

According to an embodiment of the disclosure, the decision to increase the speed of a fan or a pump associated with a liquid-to-air heat exchanger is based on evaluating the gradient in heat transfer to power input, dQ/dP.

One example of a liquid-to-air heat exchanger to which the present disclosure applies is commonly called a radiator. Although the predominant heat transfer mode associated with the radiator is actually convection, it is commonly referred to as a radiator. For convenience and simplicity, the liquid-to-air heat exchanger is referred to as a radiator in the following description.

Figure 1:
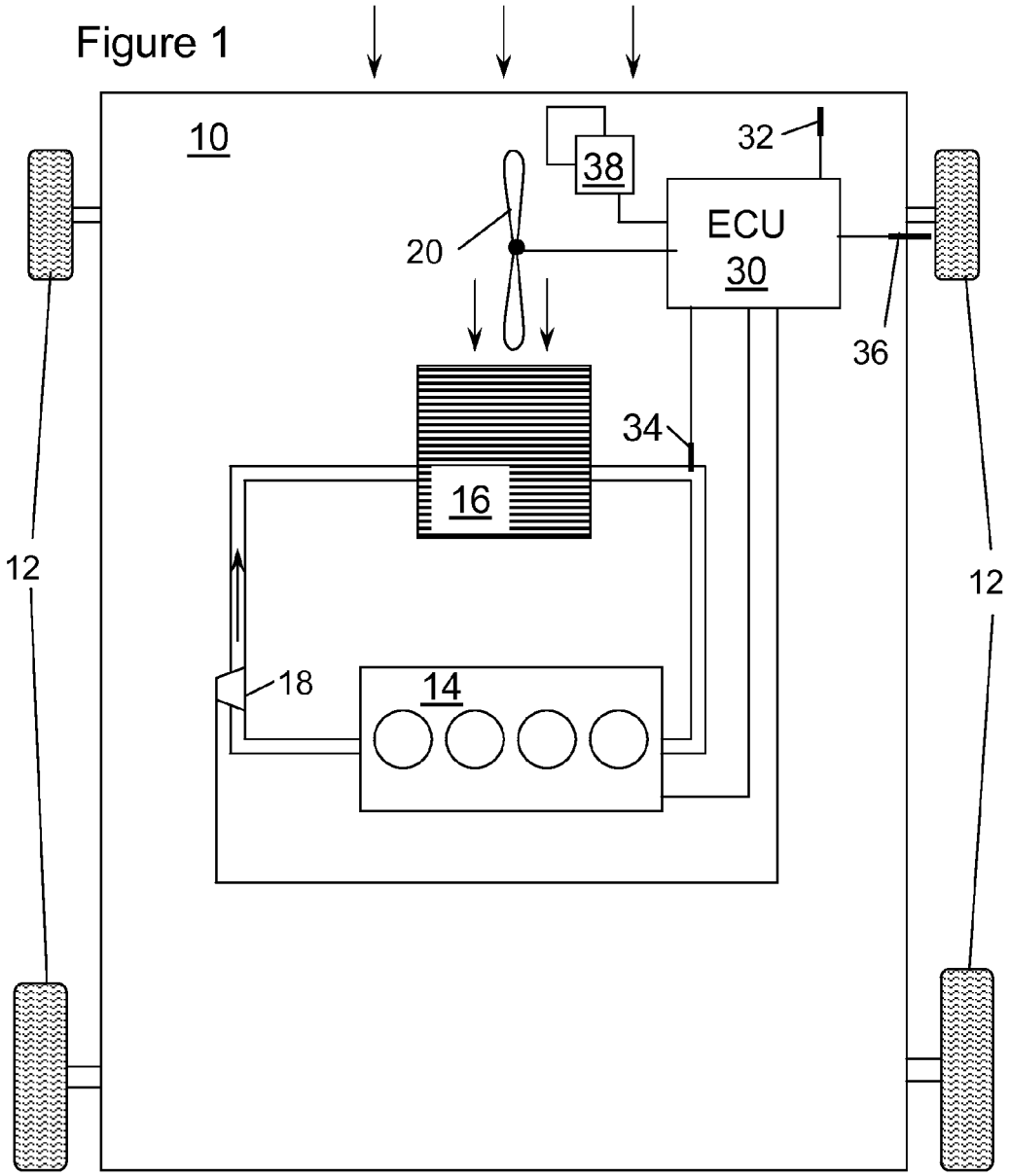
FIG. 1 is a schematic of an automotive coolant system.

In FIG. 1, a vehicle 10 having four wheels 12, an internal combustion engine 14, and a radiator 16 for providing cooling for engine 14 is shown. A liquid coolant, typically a mixture of water and ethylene glycol, is provided to a water jacket cast in engine 14 by a pump 18. Typically, pump 18 is driven by engine 14. However, in some applications, pump 18 is either electrically driven, driven by a variable speed clutch, hydraulically driven, or driven by some other actively controllable means so that pump 18 can be operated partially or fully independently of engine rotational speed. A fan 20 which is either electrically driven, driven by a variable speed clutch, hydraulically driven, or driven by some other actively controllable means is provided proximate radiator 16. Air is forced across radiator 16 due to vehicle speed and/or fan 20.

An electronic control unit (ECU) 30 is coupled to a variety of sensors and actuators, which may include, but is not limited to: ambient air temperature sensor 32, engine coolant temperature sensor 34, engine 14, water pump 18, fan 20, vehicle speed sensor 36, and other sensors and actuators 38.

For a radiator having a particular architecture and deploying specific heat transfer media, a map of its heat transfer performance characteristics can be determined experimentally, analytically, or by a combination of the two. The resultant heat transfer performance map may take on the form of a dimensionless, heat-exchanger effectiveness. An example two-dimensional lookup table is shown in Table 1 in which the heat transfer media are engine coolant and air and the effectiveness is based on the flows and/or resultant velocities of the two heat transfer media:

TABLE 1

| Radiator Effectiveness | | | | | | | | | | | |
|---|---|---|---|---|---|---|---|---|---|---|---|
| | | Airlow: Standard Air Velocity (m/s) | | | | | | | | | |
| | | 1.20 | 1.60 | 2.00 | 2.40 | 2.80 | 3.20 | 3.60 | 4.00 | 4.40 | 4.80 |
| Coolant flow [kg/s] | 0.50 | 0.826 | 0.765 | 0.710 | 0.660 | 0.616 | 0.577 | 0.542 | 0.511 | 0.483 | 0.458 |
| | 0.75 | 0.852 | 0.799 | 0.749 | 0.704 | 0.663 | 0.626 | 0.592 | 0.561 | 0.534 | 0.508 |
| | 1.00 | 0.866 | 0.818 | 0.772 | 0.729 | 0.690 | 0.654 | 0.621 | 0.592 | 0.564 | 0.539 |
| | 1.25 | 0.875 | 0.830 | 0.786 | 0.746 | 0.708 | 0.673 | 0.641 | 0.612 | 0.585 | 0.560 |
| | 1.50 | 0.881 | 0.838 | 0.797 | 0.757 | 0.721 | 0.687 | 0.656 | 0.627 | 0.600 | 0.576 |
| | 1.75 | 0.900 | 0.863 | 0.827 | 0.792 | 0.758 | 0.726 | 0.696 | 0.668 | 0.642 | 0.618 |
| | 2.00 | 0.911 | 0.879 | 0.847 | 0.816 | 0.786 | 0.757 | 0.729 | 0.703 | 0.678 | 0.655 |
| | 2.25 | 0.918 | 0.890 | 0.861 | 0.833 | 0.805 | 0.778 | 0.752 | 0.728 | 0.704 | 0.682 |
| | 2.50 | 0.923 | 0.898 | 0.871 | 0.845 | 0.819 | 0.794 | 0.770 | 0.747 | 0.725 | 0.703 |
| | 2.75 | 0.927 | 0.903 | 0.879 | 0.855 | 0.830 | 0.807 | 0.784 | 0.762 | 0.740 | 0.720 |

The heat transfer rate is related to effectiveness:

$$Q=\epsilon*C*v*(T_{coolant,in}-T_{air,in})$$

where Q is the heat transfer rate in W, $\epsilon$ is the effectiveness, C is the heat capacity of the lower heat capacity fluid in J/kg-K, v is the mass flow rate of the lower heat capacity fluid in kg/s, $T_{coolant,in}$ is the temperature of engine coolant as it enters the radiator in K, and $T_{air,in}$ is the temperature of the air as it approaches the radiator in K. From the above equation, the heat transfer as a function of fluid flows can be computed and an example of which is shown in Table 2:

TABLE 2

| Heat Transfer in Watts | | | | | | | | | | | |
|---|---|---|---|---|---|---|---|---|---|---|---|
| | | Airlow: Standard Air Velocity (m/s) | | | | | | | | | |
| | | 1.20 | 1.60 | 2.00 | 2.40 | 2.80 | 3.20 | 3.60 | 4.00 | 4.40 | 4.80 |
| Coolant flow [kg/s] | 0.50 | 10573 | 13058 | 15141 | 16900 | 18400 | 19694 | 20820 | 21803 | 22674 | 23451 |
| | 0.75 | 10907 | 13640 | 15992 | 18028 | 19803 | 21363 | 22740 | 23965 | 25062 | 26046 |
| | 1.00 | 11084 | 13957 | 16467 | 18668 | 20609 | 22332 | 23868 | 25249 | 26489 | 27617 |
| | 1.25 | 11197 | 14160 | 16777 | 19090 | 21147 | 22984 | 24632 | 26119 | 27469 | 28692 |
| | 1.50 | 11284 | 14305 | 16996 | 19392 | 21535 | 23458 | 25189 | 26759 | 28187 | 29490 |
| | 1.75 | 11516 | 14737 | 17649 | 20275 | 22648 | 24799 | 26751 | 28525 | 30148 | 31635 |
| | 2.00 | 11656 | 15008 | 18082 | 20895 | 23469 | 25833 | 27998 | 29992 | 31828 | 33523 |
| | 2.25 | 11750 | 15190 | 18378 | 21324 | 24049 | 26566 | 28900 | 31058 | 33066 | 34931 |
| | 2.50 | 11816 | 15320 | 18591 | 21639 | 24475 | 27119 | 29576 | 31873 | 34014 | 36016 |
| | 2.75 | 11865 | 15419 | 18756 | 21880 | 24804 | 27542 | 30106 | 32504 | 34760 | 36871 |

In an automotive application, the air provided to the radiator may or may not be ducted and the temperature may be ambient temperature. In some applications, however, the temperature of the air is heated upstream of the radiator, i.e., it is exposed to other heat loads prior to being supplied to the radiator. In the automotive application, the velocity of the air blowing across the radiator is based on several factors including both the speed of the fan and the velocity of the vehicle. Temperatures may be inferred from provided engine sensors, such as engine coolant temperature and ambient temperature where applicable. Coolant velocity or mass flowrate is based on the pump speed and system architecture. Additional modeling may be required to account for the factors specific to the particular application and the particular present operating condition. The results of these models may be utilized in the ECU, or the models may themselves reside in the ECU and may be exercised in real time to provide the necessary information.

Next, gradients of heat transfer vs. fluid flow, dQ/dv can be determined for each of the fluids, as shown in Tables 3 and 4:

TABLE 3

| Gradient of Heat Transfer Versus Coolant Flow (Delta Heat Transfer)/(Delta Coolant Flow in units of (W-s/kg) | | | | | | | | | | | |
|---|---|---|---|---|---|---|---|---|---|---|---|
| | | Airlow: Standard Air Velocity (m/s) | | | | | | | | | |
| | | 1.20 | 1.60 | 2.00 | 2.40 | 2.80 | 3.20 | 3.60 | 4.00 | 4.40 | 4.80 |
| Coolant flow [kg/s] | 0.50 | 1336 | 2327 | 3404 | 4514 | 5613 | 6674 | 7677 | 8650 | 9552 | 10379 |
| | 0.75 | 711 | 1269 | 1902 | 2559 | 3224 | 3876 | 4514 | 5135 | 5705 | 6285 |
| | 1.00 | 450 | 812 | 1237 | 1689 | 2150 | 2607 | 3055 | 3480 | 3922 | 4299 |
| | 1.25 | 348 | 580 | 879 | 1208 | 1552 | 1897 | 2226 | 2559 | 2871 | 3194 |
| | 1.50 | 926 | 1726 | 2610 | 3531 | 4454 | 5364 | 6249 | 7063 | 7844 | 8578 |
| | 1.75 | 563 | 1085 | 1732 | 2477 | 3284 | 4135 | 4990 | 5869 | 6718 | 7554 |
| | 2.00 | 374 | 730 | 1186 | 1720 | 2317 | 2934 | 3608 | 4265 | 4954 | 5630 |
| | 2.25 | 266 | 519 | 853 | 1259 | 1708 | 2211 | 2702 | 3259 | 3791 | 4340 |
| | 2.50 | 194 | 396 | 657 | 962 | 1314 | 1692 | 2119 | 2525 | 2984 | 3419 |
| | 2.50 | 194 | 396 | 657 | 962 | 1314 | 1692 | 2119 | 2525 | 2984 | 3419 |
| | 2.75 | Forward difference not available | | | | | | | | | |

TABLE 4

| Gradient of Heat Transfer Versus Air Flow (Delta Heat Transfer)/(Delta Air Flow in units of (W-s/kg) | | | | | | | | | | | |
|---|---|---|---|---|---|---|---|---|---|---|---|
| | | Airlow: Standard Air Velocity (m/s) | | | | | | | | | |
| | | 1.20 | 1.60 | 2.00 | 2.40 | 2.80 | 3.20 | 3.60 | 4.00 | 4.40 | 4.80 |
| Coolant flow [kg/s] | 0.50 | 6213 | 5208 | 4397 | 3750 | 3236 | 2815 | 2457 | 2178 | 1942 | Forward difference not available |
| | 0.75 | 6833 | 5880 | 5091 | 4437 | 3899 | 3442 | 3064 | 2742 | 2459 | |
| | 1.00 | 7181 | 6276 | 5502 | 4853 | 4307 | 3841 | 3453 | 3099 | 2821 | |
| | 1.25 | 7407 | 6542 | 5784 | 5140 | 4592 | 4121 | 3718 | 3375 | 3057 | |
| | 1.50 | 7552 | 6728 | 5990 | 5356 | 4808 | 4327 | 3926 | 3570 | 3259 | |
| | 1.75 | 8052 | 7280 | 6566 | 5933 | 5376 | 4880 | 4435 | 4058 | 3717 | |
| | 2.00 | 8379 | 7685 | 7032 | 6437 | 5908 | 5414 | 4984 | 4589 | 4239 | |
| | 2.25 | 8602 | 7969 | 7366 | 6810 | 6294 | 5836 | 5394 | 5020 | 4662 | |
| | 2.50 | 8759 | 8178 | 7620 | 7091 | 6609 | 6143 | 5742 | 5353 | 5005 | |
| | 2.75 | 8885 | 8341 | 7810 | 7310 | 6845 | 6409 | 5996 | 5639 | 5277 | |

Figure 2:
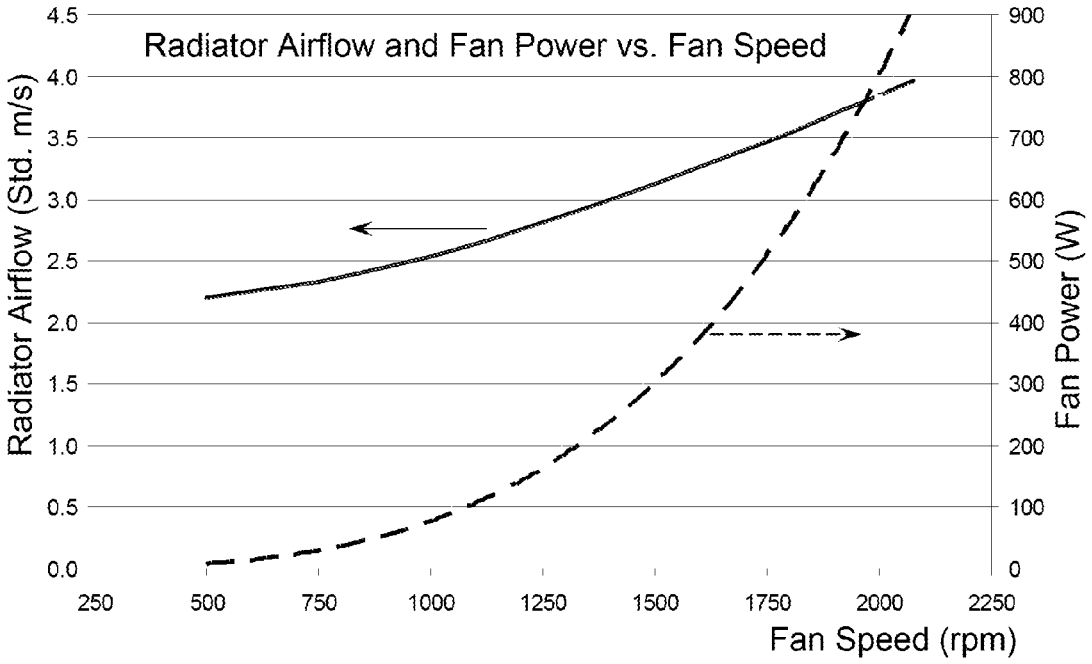
FIG. 2 is a graph of radiator coolant flow and pump power as a function of pump speed.
Figure 3:
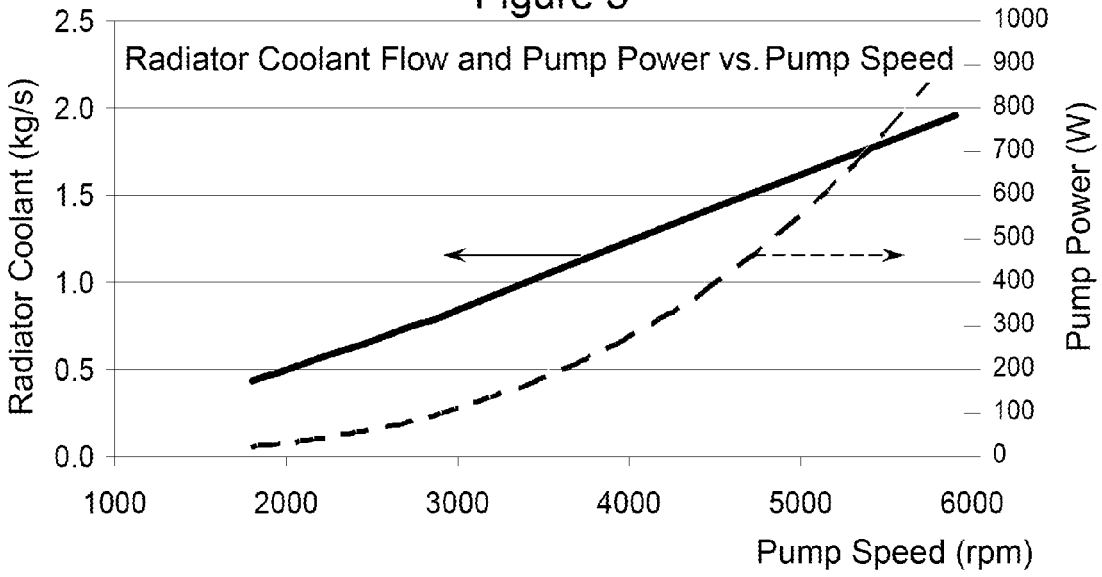
FIG. 3 is a graph of radiator airflow and fan power as a function of fan speed.

The pump power and coolant flow are shown as a function of pump speed in FIG. 2 for a given set of vehicular operating conditions. Similarly, fan power and relative air flow rate are plotted as a function of fan speed in FIG. 3 for the same set of vehicular operating conditions. The data plotted in FIGS. 2 and 3 may be generating using models, may come from test data, or a combination of the two. In the case of airflow, the complicated influences of ram air and air side heat rejection may be included in the model. From the data in FIGS. 2 and 3, a relationship between pump power vs. coolant flow (Table 4) and a relationship between fan power vs. air flow (Table 5) can be determined:

TABLE 4

Radiator Coolant Flow as a Function of Pump Power

| Coolant Flow | Pump Power (W) |
|---|---|
| 0.50 | 31.8 |
| 0.75 | 84.5 |
| 1.00 | 167.7 |
| 1.25 | 287.4 |
| 1.50 | 452.2 |
| 1.75 | 675.6 |
| 2.00 | 980.9 |
| 2.25 | 1414.6 |

TABLE 5

Air Flow as a Function of Fan Power

| Air flow | Fan Power (W) |
|---|---|
| 2.40 | 47.1 |
| 2.80 | 174.1 |
| 3.20 | 352.7 |
| 3.60 | 587.1 |
| 4.00 | 889.5 |
| 4.40 | 1282.4 |

Based on the data in the tables above, gradients in coolant flow to pump power and air flow to fan power can be determined, as in Tables 6 and 7:

TABLE 6

Gradient in coolant flow as a function of coolant flow.

| Coolant Flow (kg/s) | (Delta Coolant Flow/Delta Pump Power) (W-s/kg) |
|---|---|
| 0.50 | 4.748E−03 |
| 0.75 | 3.003E−03 |
| 1.00 | 2.089E−03 |
| 1.25 | 1.517E−03 |
| 1.50 | 1.119E−03 |
| 1.75 | 8.188E−04 |
| 2.00 | 5.765E−04 |
| 2.25 | NA |

TABLE 7

Gradient in air flow as a function of air flow.

| Air Flow (Std. m/s) | (Delta Airflow/Delta Fan Power) (W-s/kg) |
|---|---|
| 2.40 | 3.150E−03 |
| 2.80 | 2.240E−03 |
| 3.20 | 1.706E−03 |
| 3.60 | 1.323E−03 |
| 4.00 | 1.018E−03 |
| 4.40 | NA |

At this point, dQ/dv and dv/dP are known for each fluid. From these, two values of dQ/dP, i.e., for coolant and air, can be determined. Examples of these tables are shown in Tables 8 and 9:

TABLE 8

Gradient of Heat Transfer as a Function of Pump Power (W/W)

| | | Airlow: Standard Air Velocity (m/s) | | | | |
|---|---|---|---|---|---|---|
| | | 2.40 | 2.80 | 3.20 | 3.60 | 4.00 |
| Coolant flow [kg/s] | 0.50 | 21.43 | 26.65 | 31.69 | 36.45 | 41.06 |
| | 0.75 | 7.69 | 9.68 | 11.64 | 13.56 | 15.42 |
| | 1.00 | 3.53 | 4.49 | 5.45 | 6.38 | 7.27 |
| | 1.25 | 1.83 | 2.36 | 2.88 | 3.38 | 3.88 |
| | 1.50 | 3.95 | 4.98 | 6.00 | 6.99 | 7.90 |
| | 1.75 | 2.03 | 2.69 | 3.39 | 4.09 | 4.81 |
| | 2.00 | 0.99 | 1.34 | 1.69 | 2.08 | 2.46 |

TABLE 9

Gradient of Heat Transfer as a Function of Fan Power (W/W).

| | | Airlow: Standard Air Velocity (m/s) | | | | |
|---|---|---|---|---|---|---|
| | | 2.40 | 2.80 | 3.20 | 3.60 | 4.00 |
| Coolant flow [kg/s] | 0.50 | 11.81 | 7.25 | 4.80 | 3.25 | 2.22 |
| | 0.75 | 13.98 | 8.73 | 5.87 | 4.05 | 2.79 |
| | 1.00 | 15.29 | 9.64 | 6.55 | 4.57 | 3.15 |
| | 1.25 | 16.19 | 10.28 | 7.03 | 4.92 | 3.44 |
| | 1.50 | 16.87 | 10.77 | 7.38 | 5.19 | 3.63 |
| | 1.75 | 18.69 | 12.04 | 8.33 | 5.87 | 4.13 |
| | 2.00 | 20.28 | 13.23 | 9.24 | 6.59 | 4.67 |

Based on the data in Tables 8 and 9, the more efficient device, fan or pump, can be commanded to increase output to respond to a demand for additional cooling. For example, if the present coolant flow is 1.25 kg/s and the present air velocity is 2.8 m/s, dQ/dP for the pump is 2.36 and for the fan, 10.28. In this example, the fan provides the greater heat transfer rate for the same input power.

The selection of which device to actuate to provide improved heat transfer is described above in terms of two-dimensional lookup tables. However, this is a non-limiting example. The determination can be based on data in graphical form, a set of empirical relationships of the data, a comprehensive model including all of the relevant factors, or any other suitable alternative. In regards to the above discussion, heat transfer leading to energy being removed from the coolant is considered to be positive and power supplied to the device (either fan or pump) is considered to be positive.

A flowchart showing an embodiment of the disclosure is shown. After the vehicle is started in 100, control passes to 102 in which it is determined whether there is an increased demand for cooling. In so, control falls through to block 104 in which dQ/dP for the fan and dQ/dP for the pump are determined. In block 106, the two are compared. If dQ/dP for the pump is greater, control passes to 108 for increasing pump speed. If dQ/dP for the fan is greater, the fan speed is increased in block 110. Control from block 108 and 110 returns to block 102.

The discussion above focuses on selecting the appropriate actuator to employ to meet a demand for additional cooling. It is also within the scope of the present disclosure to select the appropriate device to reduce heat transfer. In this case, dQ is negative and dP are negative because the rate of heat transfer is decreasing as well as the power input decreasing. In this situation, the device which has the lesser dQ/dP associated with it is the one that is commanded to reduce speed. The determination of the gradients dQ/dP for this situation can be determined analogously as for the situation where an increased heat transfer rate is indicated.

Figure 5:
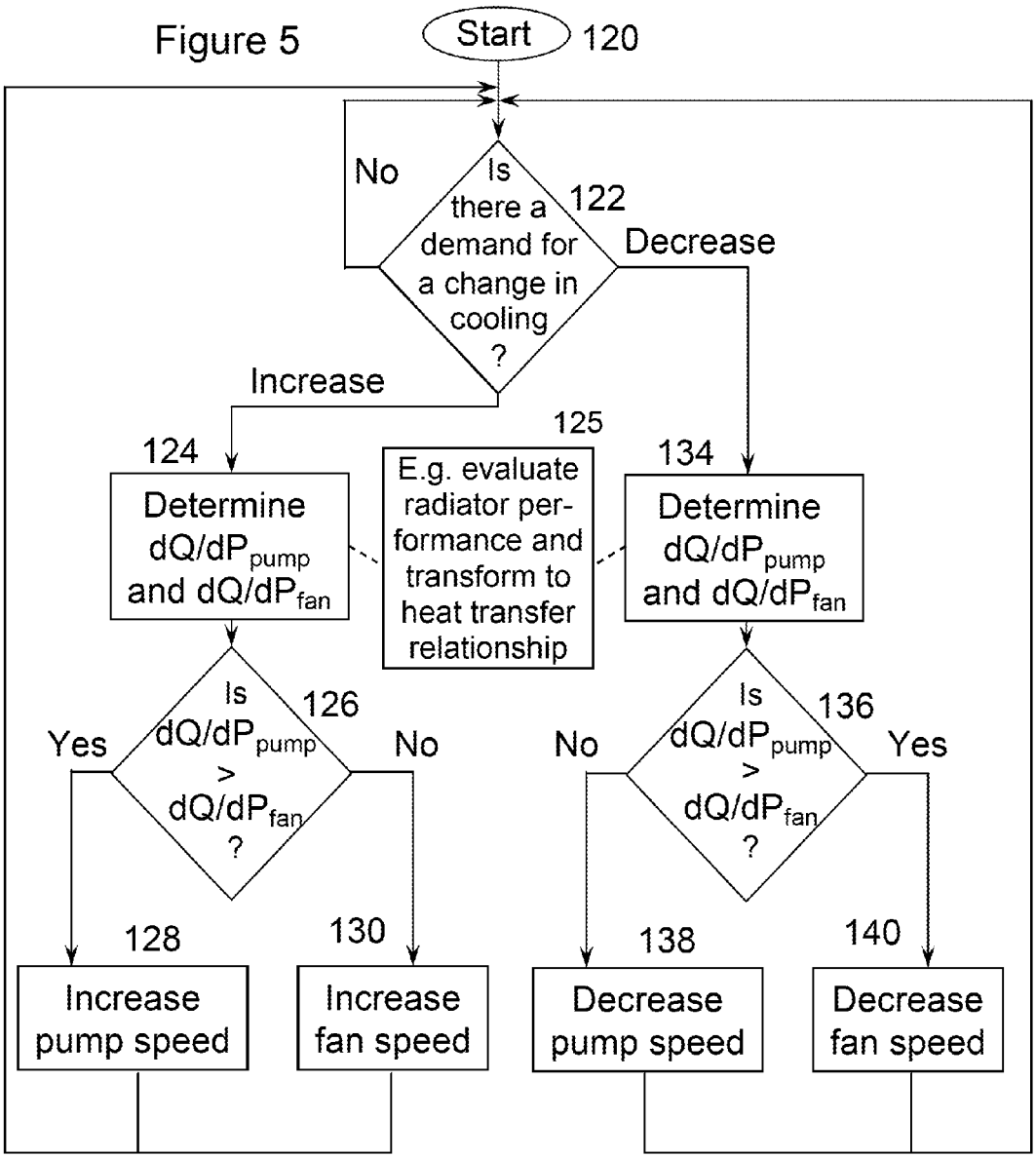

A flow chart showing both increases and decreases in heat transfer rate is shown in FIG. 5 and starts in 120. Control passes to 122 in which it is determined if an increase or decrease in heat transfer rate is indicated. In one embodiment, only a heat transfer rate change exceeding a threshold level is enough to rise to the level of indicating a change in pump or fan speed. I.e., some hysteresis can be built in to avoid continuous changes in pump and/or fan speed. If the desired level of heat transfer change exceeds the threshold and it is determined in block 122 that an increase in heat transfer rate is warranted, control passes to block 124 to determine both values of dQ/dP. In embodiments where the liquid-to-air heat exchanger is a radiator, the values of dQ/dP may be determined by evaluating a radiator performance relationship with radiator performance as a function of liquid coolant and air flows and/or velocities and transforming the radiator performance relationship into a heat transfer performance relationship with heat transfer rate as a function of liquid coolant and air flows and/or velocities, as illustrated at block 125. As the branch including blocks 124, 126, 128, and 130 is the same as blocks 104, 106, 108, and 110, no further discussion of this branch is provided. If it is determined in block 122 that a decrease in heat transfer rate is warranted, control passes to 134 to determine both values of dQ/dP. The values of d/Q/dP may, for example, be determined as illustrated in block 125 and discussed above. The two values are compared in block 136. If dQ/dP for the pump is greater than dQ/dP for the fan, control passes to block 140 where fan speed is decreased. Otherwise control passes to block 138 in which pump speed is decreased. After any of the changes in fan or pump speed, i.e., in block 128, 130, 138, or 140, control passes back to block 122.

In the embodiment in FIG. 5, a change in speed is commanded to one or the other of the pump and the fan. However, it is possible to determine a condition in which both are changed with the same constraint that the power increase is the minimum possible. If the computation interval is sufficiently short, the small changes in heat transfer to one or the other becomes essentially similar to combinations of changes to the two. Also, if the computation interval is short, the resulting changes in pump, or fan, speed are small steps.

The data in Tables 8 and 9 can be utilized to determine a region in which the gradient in dQ/dP is equal for the fan and the pump, shown as 150 in FIG. 6. An increase in heat transfer is to be provided by the fan if the present operating condition falls above the line and to be provided by the pump if the present operating condition falls above the line. In operation, the algorithm will cause the operating condition to remain close to line 150.

The tables above are shown for a specific arrangement and a specific set of operating conditions. The tables are updated continuously to reflect present conditions by a real time running model, results from such a model, test data, or a suitable combination. Also, in the above tables, coolant is provided as a mass flowrate and airflow as a velocity. However, any measure of flow can be used for either: mass flowrate, volumetric flowrate, velocity, as examples. As described herein, sensors may be used to provide input to models. However, there is a desire to minimize the sensor set to reduce cost. Thus, some of the quantities used in the models may be inferred based on sensor signals, actuator settings, or inferred from other sensor signals.

While the best mode has been described in detail, those familiar with the art will recognize various alternative designs and embodiments within the scope of the following claims. Where one or more embodiments have been described as providing advantages or being preferred over other embodiments and/or over background art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. A method to control cooling in a liquid-to-air heat exchanger with a fan and a pump forcing convection, the method comprising:

adjusting a fan speed or a pump speed in response to a difference between a first gradient associated with adjusting fan speed and a second gradient associated with adjusting pump speed, the first gradient relating heat transfer rate to fan power input and the second gradient relating heat transfer rate to pump power input.

2. The method of claim 1, wherein the adjusting one of fan speed and pump speed is further based on a change in heat transfer rate being requested.

3. The method of claim 2 wherein:

the fan speed is increased when the first gradient is greater than the second gradient and an increase in heat transfer rate is requested;

the pump speed is increased when the second gradient is greater than the first gradient and an increase in heat transfer rate is requested;

the fan speed is decreased when the second gradient is greater than the first gradient and a decrease in heat transfer rate is requested; and the pump speed is decreased when the first gradient is greater than the second gradient and a decrease in heat transfer rate is requested.

4. The method of claim 1 wherein the liquid-to-air heat exchanger comprises a coolant comprising water and ethylene glycol.

5. The method of claim 1 wherein the liquid-to-air heat exchanger comprises a liquid contained within a duct and the air is ducted or unducted.

6. The method of claim 1 wherein the liquid-to-air heat exchanger is a radiator and the first and second gradients are based on:

evaluating a radiator performance relationship as a function of a liquid coolant flow and an air flow; and transforming the radiator performance relationship into a heat transfer performance relationship with heat transfer rate as a function of liquid coolant and air flows.

7. The method of claim 6 wherein the flows are expressed in one of: mass flowrate, volumetric flowrate, and velocity.

8. The method of claim 6 wherein the performance relationships may be expressed as lookup tables, graphs, or empirical formulas.

9. The method of claim 1 wherein:

the first gradient corresponds to an increase in fan speed and the second gradient corresponds to an increase in pump speed when an increase in heat transfer rate is requested; and the first gradient corresponds to a decrease in fan speed and the second gradient corresponds to a decrease in pump speed when a decrease in heat transfer rate is requested.

10. A method to control cooling in a liquid-to-air heat exchanger with a fan and a pump forcing convection, the method comprising:

increasing fan speed when a first gradient is greater than a second gradient, the first gradient associating heat transfer rate to power for increasing fan speed and the second gradient associating heat transfer rate to power for increasing pump speed.

11. The method of claim 10, further comprising:

increasing pump speed when the second gradient is greater than the first gradient.

12. The method of claim 11, wherein increasing the pump speed is further based on a determination that an increase in heat transfer rate is desired.

13. The method of claim 10 wherein the first gradient is based on a gradient in heat transfer rate to air flow from a map of radiator performance and a gradient in air flow to fan power.

14. The method of claim 10 wherein the second gradient is based on a gradient in heat transfer rate to coolant flow from a map of radiator performance and determining a gradient in coolant flow to fan power.

15. A method to control cooling in a liquid-to-air heat exchanger with a fan and a pump forcing convection, comprising:

increasing fan speed in response to a first gradient in heat transfer rate to power exceeding a second gradient in heat transfer rate to power for increasing pump speed; and increasing pump speed when the second gradient is greater than the first gradient.

16. The method of claim 15, further comprising:

increasing the pump speed in response to a desired increase in heat transfer rate.

17. The method of claim 15 wherein the first gradient is based on a gradient in heat transfer rate to air flow from a map of radiator performance.

18. The method of claim 15 wherein the second gradient is based on a gradient in heat transfer rate to coolant flow from a map of radiator performance.

19. The method of claim 15 wherein the first gradient is based on a gradient in air flow to fan power.

20. The method of claim 15 wherein the second gradient is based on a gradient in coolant flow to fan power.

* * * * *